US008049122B2

(12) United States Patent
Watford

(10) Patent No.: US 8,049,122 B2
(45) Date of Patent: Nov. 1, 2011

(54) MOISTURE RESISTANT PUSH TO TEST BUTTON FOR CIRCUIT BREAKERS

(75) Inventor: Russell T. Watford, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 339 days.

(21) Appl. No.: 12/370,825

(22) Filed: Feb. 13, 2009

(65) Prior Publication Data

US 2009/0205939 A1 Aug. 20, 2009

Related U.S. Application Data

(60) Provisional application No. 61/029,584, filed on Feb. 19, 2008.

(51) Int. Cl.
*H01H 13/06* (2006.01)

(52) U.S. Cl. ..... 200/302.2; 200/330

(58) Field of Classification Search .... 200/302.1–302.3, 200/330, 331, 333, 334, 293
See application file for complete search history.

(56) References Cited

U.S. PATENT DOCUMENTS

| | | | | | |
|---|---|---|---|---|---|
| 3,372,246 | A | * | 3/1968 | Knuepfer | 379/368 |
| 4,339,634 | A | * | 7/1982 | Weber | 200/5 A |
| 4,538,040 | A | | 8/1985 | Ronemus | |
| 4,568,899 | A | | 2/1986 | May | |
| 4,667,263 | A | * | 5/1987 | Morris et al. | 361/42 |
| 5,550,341 | A | * | 8/1996 | Bohnert et al. | 200/296 |
| 5,552,755 | A | * | 9/1996 | Fello et al. | 335/18 |
| 5,982,593 | A | * | 11/1999 | Kimblin et al. | 361/42 |
| 6,059,445 | A | | 5/2000 | Bun | |
| 6,215,378 | B1 | * | 4/2001 | Gibson et al. | 335/18 |
| 6,626,473 | B1 | * | 9/2003 | Klein et al. | 292/347 |
| 6,768,070 | B2 | * | 7/2004 | Lewison et al. | 200/296 |
| 7,420,136 | B2 | * | 9/2008 | Goetzl et al. | 200/341 |
| 7,642,476 | B2 | * | 1/2010 | Virtanen et al. | 200/302.1 |

FOREIGN PATENT DOCUMENTS

| | | | | |
|---|---|---|---|---|
| DE | 1854480 | U | | 7/1962 |
| KR | 2007080994 | A | * | 8/2007 |
| WO | WO 2007093673 | A1 | | 8/2007 |

* cited by examiner

*Primary Examiner* — Michael Friedhofer

(57) ABSTRACT

A circuit breaker includes a housing forming an opening. A push switch is connected to a test circuit to enable testing of the test circuit in accordance with closing the push switch. A flexible membrane is formed in the opening and configured to form a seal between the housing and the flexible membrane. The flexible membrane is located in an operative relationship with the push switch such that pushing the flexible membrane results in a displacement of the push switch.

13 Claims, 7 Drawing Sheets

MOISTURE RESISTANT PUSH TO TEST BUTTON FOR CIRCUIT BREAKERS

RELATED APPLICATION INFORMATION

This application claims priority to provisional application Ser. No. 61/029,584 filed on Feb. 19, 2008, incorporated herein by reference.

BACKGROUND

1. Technical Field

This disclosure relates to circuit breakers, and more particularly, to a circuit breaker having a moisture resistant push to test button.

2. Description of the Related Art

Circuit breakers with ground fault or arc fault systems typically include a self-test button. These button designs usually include a mechanical spring, a secondary contact, and a hard plastic Push to Test (PTT) button. The test button is typically biased by a mechanical force provided by the spring. As the test button is depressed, the mechanical spring makes contact with a secondary contact. The secondary contact can be made of a similar material as the mechanical spring and may have spring type properties, or the secondary contact may be a stationary pin mounted on a printed circuit board (PCB).

One disadvantage is that a gap between the test button and a housing of the circuit breaker is present before or during when the button is depressed. When the gap between the button and the housing is present, several concerns arise related to moisture, corrosion, and potential electric shock. With the gap present, internal components are exposed to outside moisture and/or other containments that could disable the tripping functions of the test button. Although PCB's are typically conformally coated, this does not guarantee that moisture could not damage the PCB and/or related electrical components and disable the push to test button.

From a manufacturing standpoint, special care needs to be taken to ensure the contacting surfaces are not subject to corrosion or water damage. Current designs may be subject to corrosion on the contact surfaces if the mechanical parts were not properly coated, thus, disabling the push to test button functions. Further, the possibility of the user being exposed to electrical shock may be present.

SUMMARY OF THE INVENTION

A circuit breaker includes a housing forming an opening. A push switch is connected to a test circuit to enable testing of the test circuit in accordance with closing the push switch. A flexible membrane is formed in the opening and configured to form a seal between the housing and the flexible membrane. The flexible membrane is located in an operative relationship with the push switch such that pushing the flexible membrane results in a displacement of the push switch.

A flexible membrane for covering a button opening in a circuit breaker housing includes a planar section dimensioned and configured to cover an opening in a housing of a circuit breaker. A raised portion is centrally formed on the planar portion. Walls are formed about a perimeter of the planar section and form a groove about the perimeter of the planar section. The walls extend outward from the parallel portion. The walls are configured to clamp on housing walls of the circuit breaker to form a seal to exclude moisture and contaminants from the housing at the opening.

These and other objects features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present principles provide a push to test button that protects internal electrical components from moisture damage and/or other containments that could disable a circuit breaker device. In addition, the present principles provide protection for the user from an electrical shock due to the internal circuitry. The present embodiments reduce the concern for damage or injury due to moisture or other contaminants entering between the push to test button and an electronic housing of the circuit breaker. The present aspects minimize any gaps around the push to test button thus reducing the possibility of moisture or other materials from seeping in the electronic compartment and disabling the circuit breaker device. An improved seal for the button reduces the risk of electrical shock that may be present with a gap.

The present invention is not limited to the illustrative example and may be employed with other electrical devices and components. The present embodiments are illustratively described with reference to a push to test button, but may be employed with any button or device that enters through the housing wall of a circuit breaker. All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the diagrams presented herein represent conceptual views of illustrative system components and/or circuitry embodying the principles of the invention.

Figure 1:
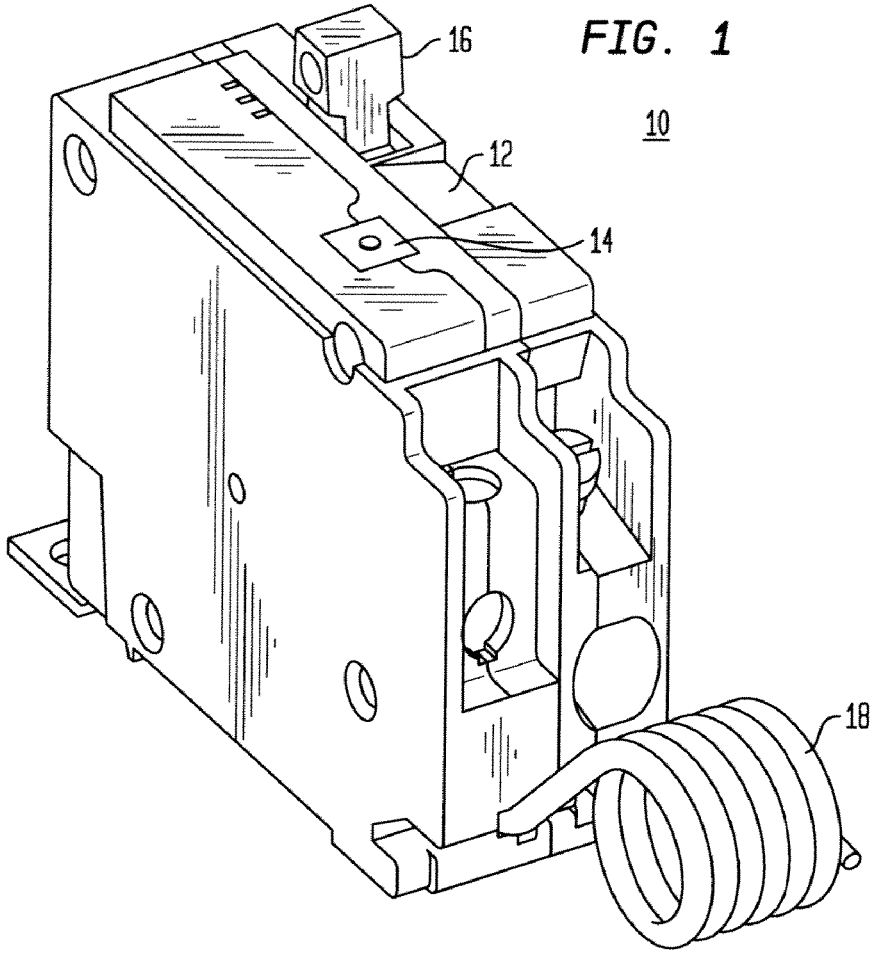
FIG. 1 is a perspective view showing a circuit breaker assembly having a flexible membrane push to test button in accordance with one embodiment.
Figure 2:
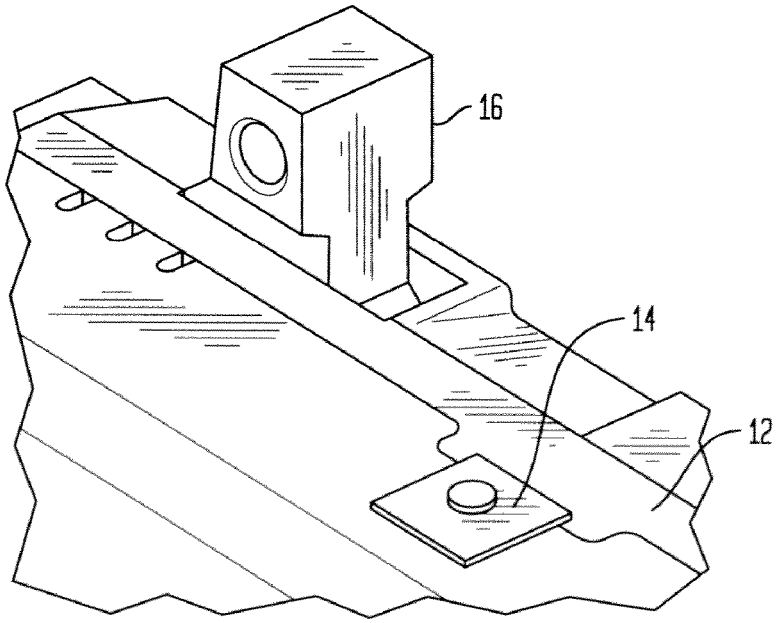
FIG. 2 is a magnified perspective view showing the flexible membrane push to test button in accordance with FIG. 1.

Referring now in specific detail to the drawings in which like reference numerals identify similar or identical elements throughout the several views, and initially to FIGS. 1 and 2, a circuit breaker 10 is illustratively shown having a push to test button 14 in accordance with the present principles. FIG. 1 shows an entire circuit breaker assembly while FIG. 2 shows a magnified view of the push to test button 14. One advantage of the present embodiment is that a superior push to test button 14 is provided where no gap is created around the push to test button 14 before the button 14 is depressed or while the button 14 is being pressed. This functionality provides moisture protection and reduces the potential of electrical shock.

Breaker 10 is depicted as a single pole breaker; however, multiple pole breakers (e.g., two pole circuit breakers) may be employed as well that include the push to test button 14 for tripping the device 10. The circuit breaker 10 may include any design having AFCI and/or GFCI protection and include thermal/magnetic protection and electronic components used to trip the circuit. A handle 16 is provided to switch the breaker 10 on or off or to reset the breaker 10 after a trip. A wire coil 18 is shown and employed for connecting the breaker 10 for operation.

Figure 3:
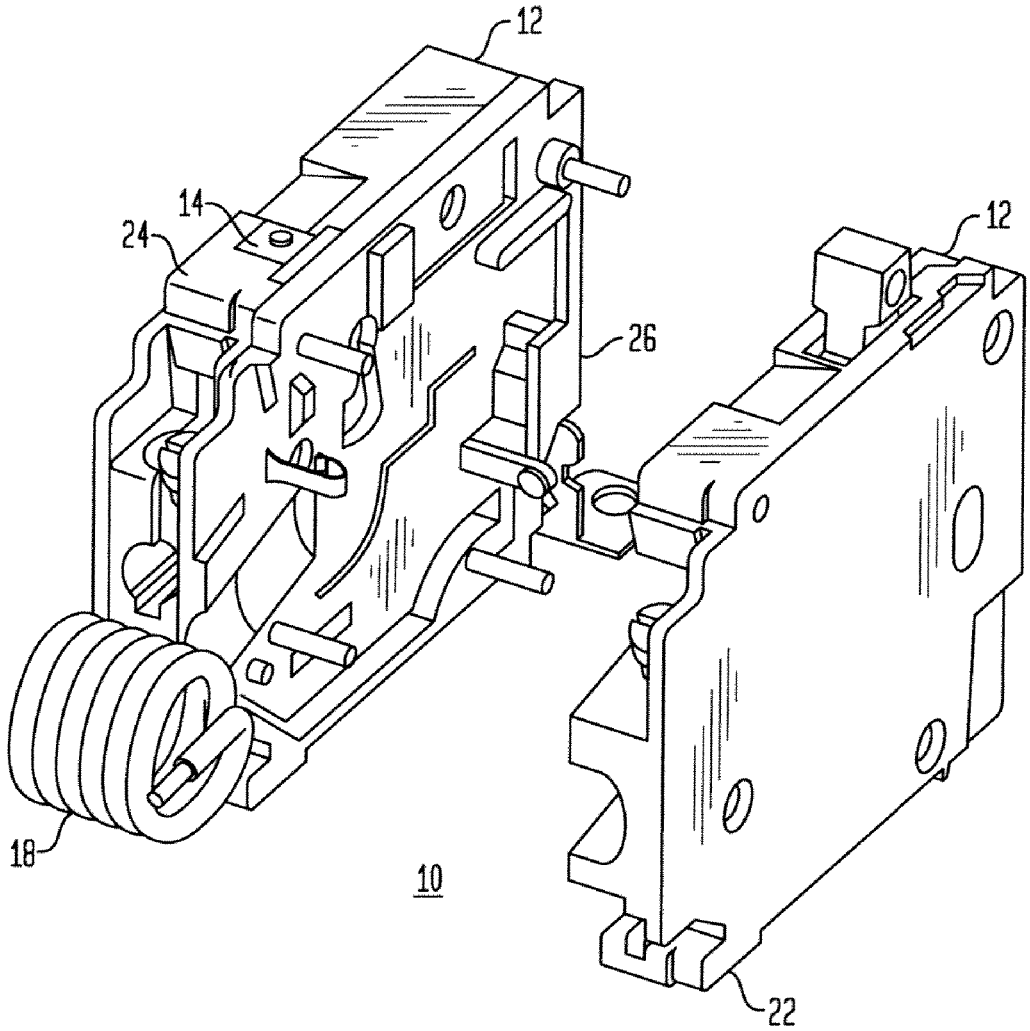
FIG. 3 is an exploded view showing a housing portion removed in accordance with one embodiment.
Figure 4:
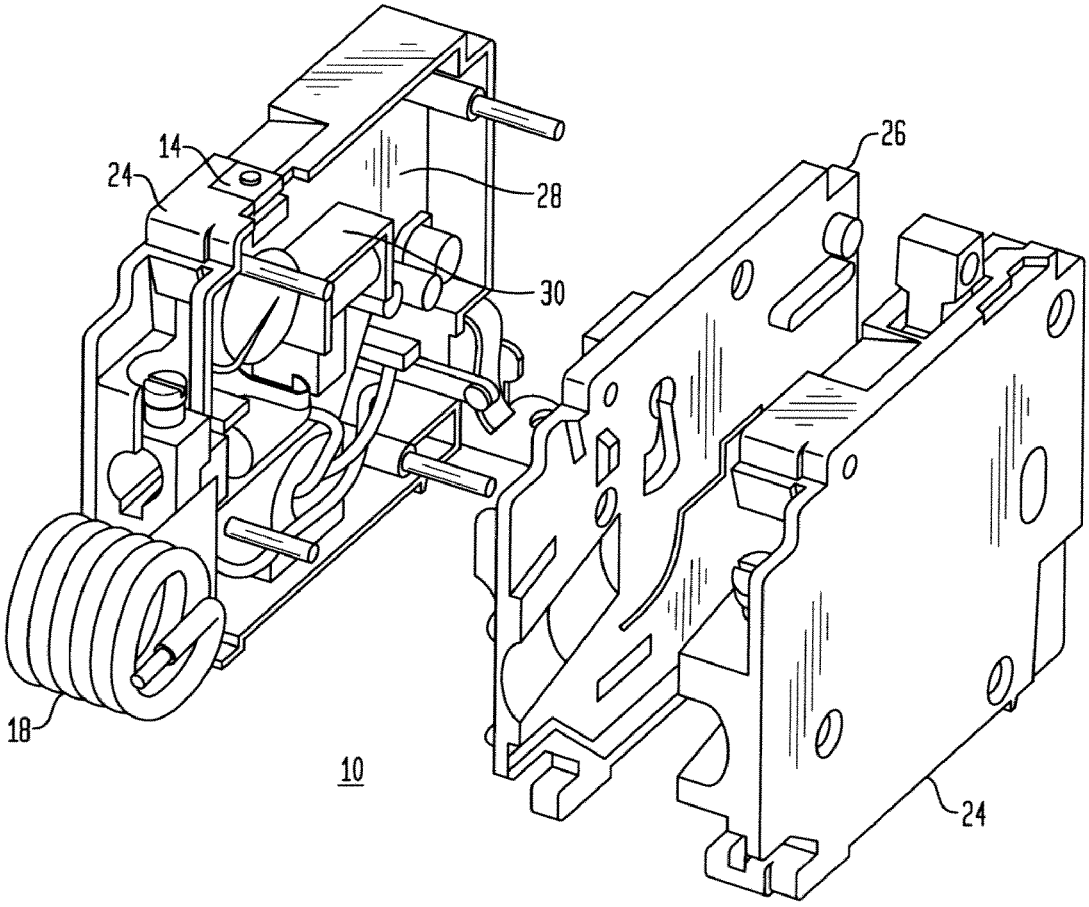
FIG. 4 is an exploded view showing a housing portion and a partition removed to show internal circuitry for operating and testing the circuit breaker in accordance with one embodiment.

Referring to FIGS. 3 and 4, exploded views of the breaker housing 10 are illustratively depicted. An electronics housing 24 includes electronic components employed in carrying out the functions of the breaker 10. For example, housing 24 includes a printed circuit board 28 employed in controlling a solenoid 30. Solenoid 30 is employed in tripping and resetting mechanical components of the circuit breaker 10. These mechanical components are provided in housing portion 22. Housing portions 22 and 24 are separated by a partition 26, which includes openings to permit interfacing between electronic components in housing 24 and the mechanical components in housing 22.

Different breaker designs may include different pole mechanisms for tripping the breaker. However, many designs include a fixed and moveable contact, where the moveable contact is attached to a moveable arm. The moveable arm is tripped under current surges and overload conditions. For GFCI and AFCI circuits, an electronic protection circuit on PCB 28 is provided that senses ground faults or arcing faults. A circuit (e.g., on the PCB 28) may be tested to determine proper operation by pressing the push to test button 14. Push to test functions are known in the art.

Figure 5:
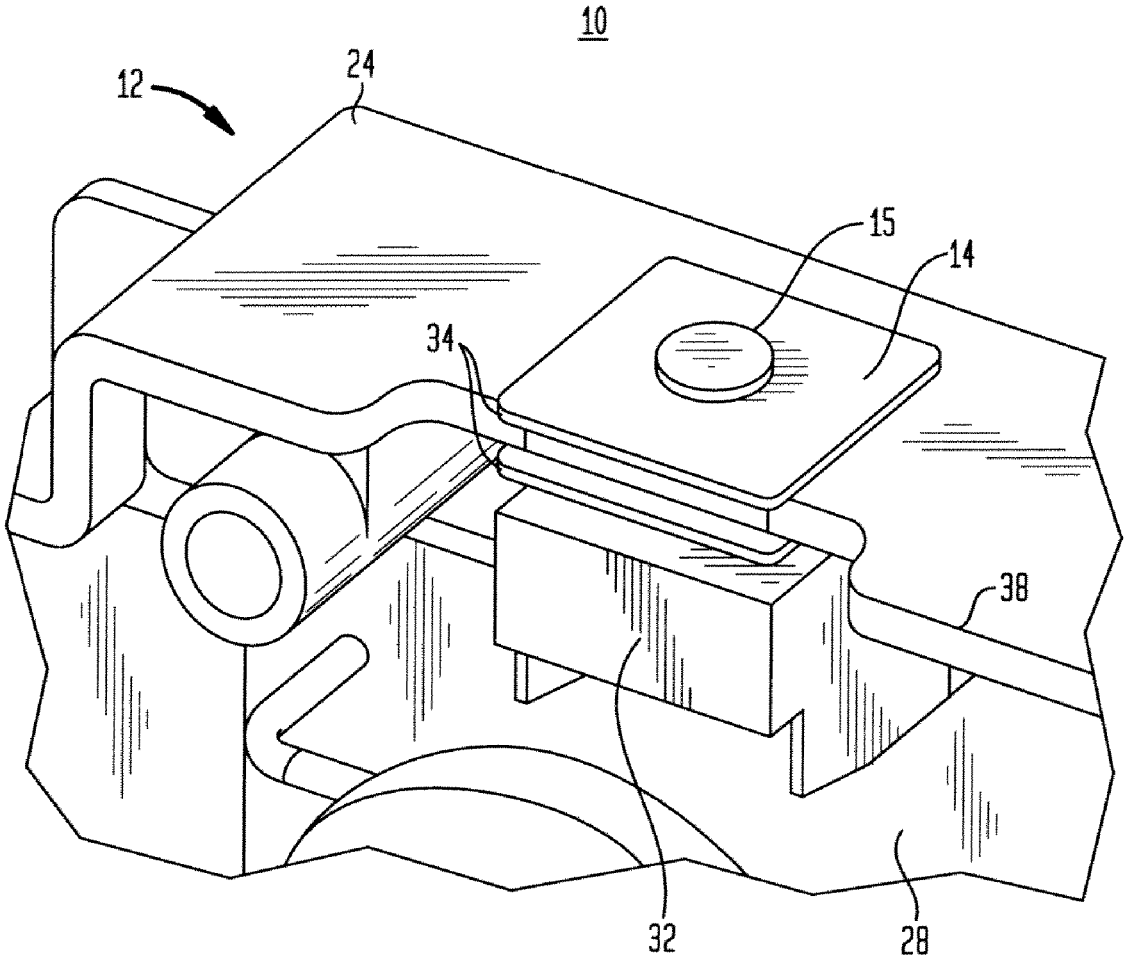
FIG. 5 is an exploded perspective view showing an electronic compartment of the breaker and showing a button interface in accordance with the present principles.
Figure 6:
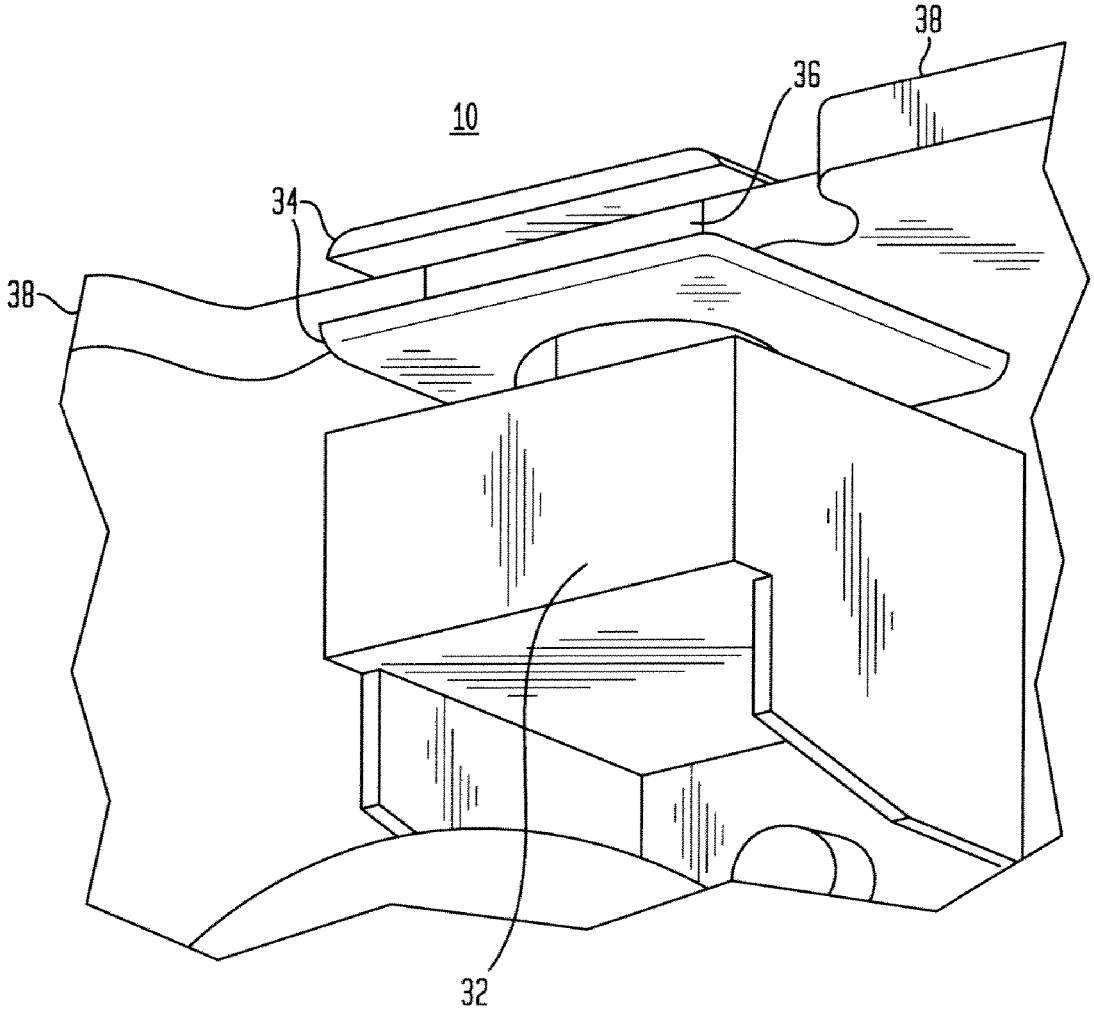
FIG. 6 is an exploded perspective view showing the electronic compartment and showing the button interface from a different angle than FIG. 5.

Referring to FIGS. 5 and 6, perspective views of the push to test button region are illustratively depicted. In FIG. 5, housing 24 is opened and shows button 14 includes a push switch 32 with an additional flexible membrane 15. The flexible membrane 15 may include a flexible material that is water or contaminant resistant. One material for membrane 15 may include rubber or a flexible polymer material. Membrane 15 includes walls 34, which form a groove 36 about a perimeter of the membrane 15. The groove 36 is designed to interface with walls 38 of the housing 12 (in this case housing portion 24 and housing portion 26 (FIG. 3)). Membrane 15 provides a seal with the surrounding housing material (e.g., plastic).

In one embodiment, the flexible membrane 15 extends over and below walls 38 of the housing 12. The dimensions of the groove 36 are preferably undersized to provide a snug fit with housing walls 38. The flexible membrane 15 is preferably formed from a dielectric material with a sufficient thickness and/or dielectric constant to prevent electrical shock to a user during operation. Any moisture or liquids in contact with the breaker 10 will not be permitted to enter the breaker 10 through the push to test button 14 as a result of the seal provided by the flexible membrane 15. With no gap present, users are limited to any exposure to electrical shock. Further, the flexible membrane 15 becomes the push to test button for the device 10, making the assembly more moisture/humidity/contaminant resistant near the test button area as compared to conventional designs.

Figure 7:
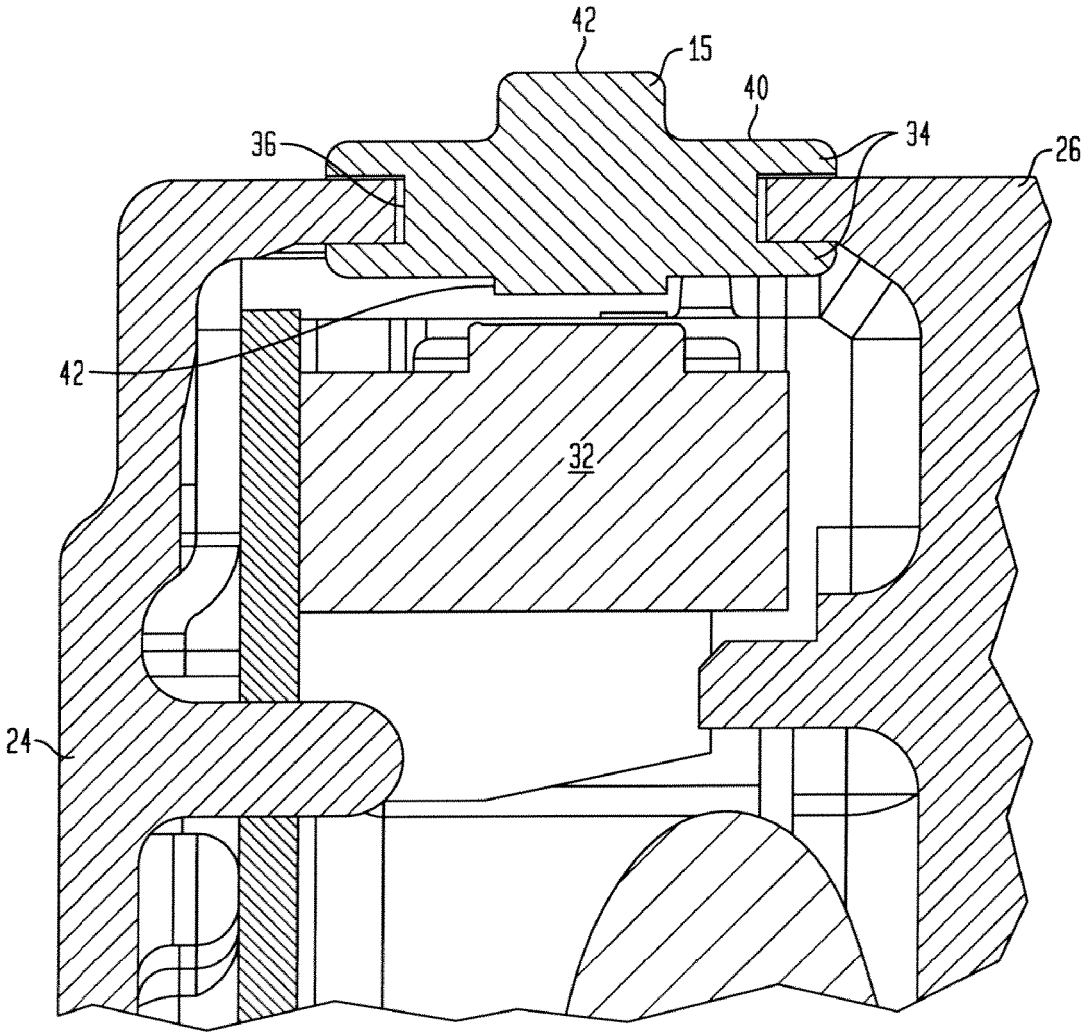
FIG. 7 is a cross-sectional view showing a front view of the button interface in accordance with the present principles.
Figure 8:
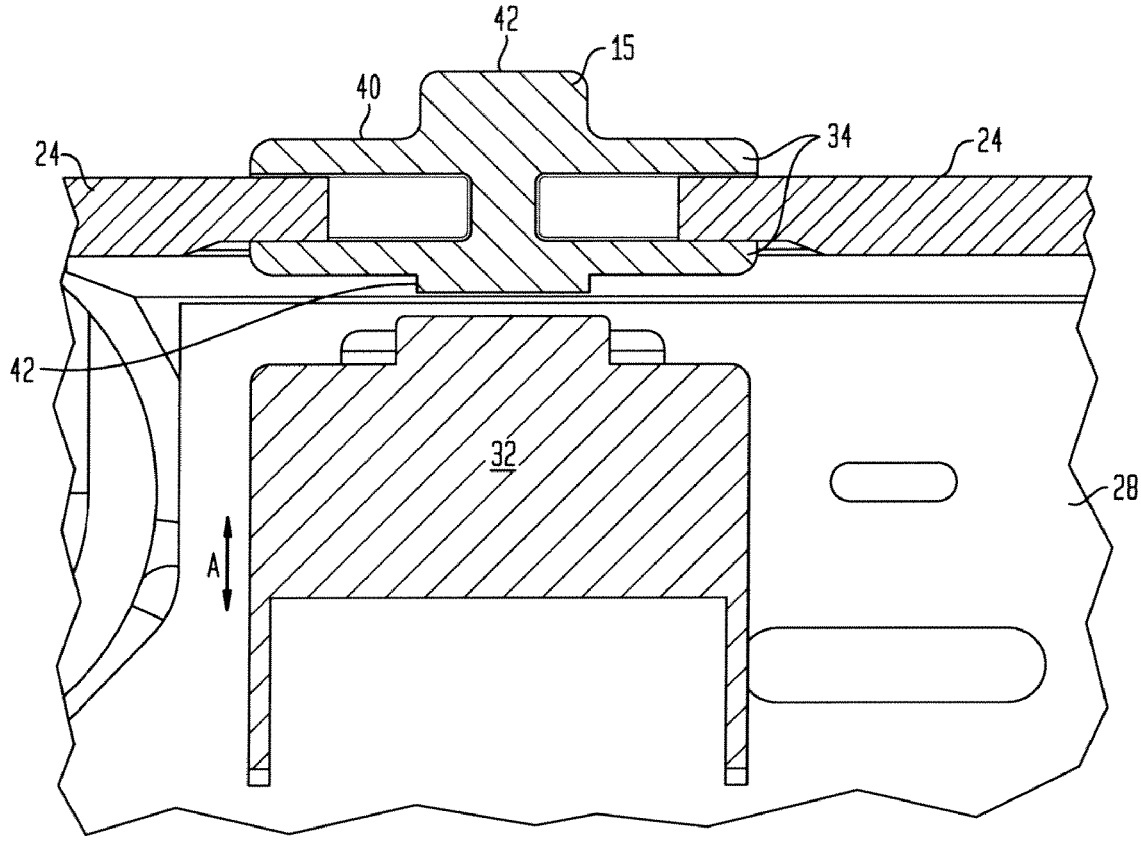
FIG. 8 is a cross-sectional view showing a side view of the button interface in accordance with the present principles.

Referring to FIGS. 7 and 8, a front cross-sectional view and a side cross-sectional view of the flexible membrane 15 are respectfully shown. Decimal dimensions are provided in inches for illustrative purposes only. Push switch 32 is biased upward by a spring or the like (not shown). When the flexible membrane 15 is pressed down in the direction of arrow "A", the push switch 32 is moved downward, and closes a self test circuit formed on PCE 28.

The flexible membrane 15 covers an opening in the circuit breaker housing. The membrane 15 includes a planar section 40 dimensioned and configured to cover the opening in the housing 24 (and 26) of the circuit breaker 10. A raised portion 42 is centrally formed on the planar section 40. The raised portion may be above the planar section 40, be below the planar section 40 or both. Walls 34 are formed about a perimeter of the planar section 40 and form a groove 36 about the perimeter of the planar section 40. The walls 34 extend outward from the planar section 40. The walls 34 are configured to clamp on housing walls 24 and 26 of the circuit breaker 10 to form a seal to exclude moisture and contaminants from the housing at the opening. The clamp on the housing walls 24 and 26 is preferably caused by an interference fit between the groove 36 and the housing walls 24 and 26.

The self-test is performed on the breaker to determine whether the breaker 10 is capable of ground or arc fault detection. The push to test button may be employed to disable the breaker. A reset button may also be employed to reset the power (turn the power back on) after a test. It should be understood a circuit breaker may have one or more buttons and the that present principles are directed to all of these buttons. For example, the push to test buttons may include a test button and/or a reset button. Other buttons may also be employed and benefit for the present teachings.

Having described preferred embodiments for moisture resistant push to test button for circuit breakers (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A circuit breaker, comprising:

a housing forming an opening;

a push switch connected to a test circuit to enable testing of the test circuit in accordance with closing the push switch; and a flexible membrane received in the opening and configured to form a seal between the housing and the flexible membrane, the flexible membrane being located in an operative relationship with the push switch such that pushing the flexible membrane results in a displacement of the push switch, the flexible membrane including:

a planar section, walls formed about a perimeter of the planar section, wherein the walls form a groove about the perimeter of the planar section, and at least two raised portions centrally formed on the planar section, the first raised portion extending above the planar section and the second raised portion extending below the planar section, wherein the second raised portion is adapted to contact and displace the push switch when the first raised portion is pushed.

2. The circuit breaker as recited in claim 1, wherein the walls are extensions of a top surface and a bottom surface of the flexible member and extend parallel with the plane section about a perimeter of the flexible member.

3. The circuit breaker as recited in claim 1, wherein the groove is dimensioned to receive a thickness of a housing wall of the housing therein.

4. The circuit breaker as recited in claim 3, wherein the groove forms an interference fit about the perimeter of the flexible member with the thickness of the housing wall.

5. The circuit breaker as recited in claim 1, wherein the flexible member includes a dielectric material to prevent electrical shock.

6. A circuit breaker, comprising:

a housing forming an opening;

a push switch connected to a test circuit to enable testing of the test circuit in accordance with closing the push switch; and a flexible membrane received in the opening and configured to form a seal between the housing and the flexible membrane, the flexible membrane being located in an operative relationship with the push switch such that pushing the flexible membrane results in a displacement of the push switch, the flexible member forming a plane and including walls about a perimeter of the plane, the walls being extensions of a top surface and a bottom surface of the flexible member and extending parallel with the plane about the perimeter of the flexible member, the walls forming a groove about the perimeter of the flexible member to receive a thickness of a housing wall of the housing therein, and two raised portions centrally formed on the plane, the first raised portion extending above the plane and the second raised portion extending below the plane, wherein the second raised portion contacts and displaces the push switch when the first raised portion is pushed.

7. The circuit breaker as recited in claim 6, wherein the groove forms an interference fit about the perimeter of the flexible member with the thickness of the housing wall.

8. The circuit breaker as recited in claim 6, wherein the flexible member includes a dielectric material to prevent electrical shock.

9. A flexible membrane for covering a button opening in a circuit breaker housing, comprising:

planar section dimensioned and configured to cover an opening in a housing of a circuit breaker;

at least two raised portions centrally formed on the planar section, the first raised portion extending above the planar section and the second raised portion extending below the planar section, wherein the second raised portion is adapted to contact and displace a push switch of a circuit breaker when the first raised portion is pushed;

walls formed about a perimeter of the planar section and forming a groove about the perimeter of the planar section, the walls extending outward from the planar section, the walls configured to clamp on housing walls of the circuit breaker to form a seal to exclude moisture and contaminants from the housing at the opening.

10. The flexible membrane as recited in claim 9, wherein the push switch is connected to a test circuit to enable testing of the test circuit in accordance with closing the push switch.

11. The flexible membrane as recited in claim 9, wherein the first raised portion is configured to extend into the housing when pressed to cause the second raised portion to contact the push switch connected to a test circuit to enable testing of the test circuit in accordance with closing the push switch.

12. The flexible membrane as recited in claim 9, wherein the groove forms an interference fit about the perimeter of the flexible member with the thickness of the housing wall.

13. The flexible membrane as recited in claim 9, wherein the flexible member includes a dielectric material to prevent electrical shock.

* * * * *